US008851095B2

(12) United States Patent
LeAnna

(10) Patent No.: US 8,851,095 B2
(45) Date of Patent: Oct. 7, 2014

(54) POLE MOUNTED COOLER

(71) Applicant: David LeAnna, Duck River, TN (US)

(72) Inventor: David LeAnna, Duck River, TN (US)

( * ) Notice: Subject to any disclaimer, the term of this patent is extended or adjusted under 35 U.S.C. 154(b) by 0 days.

(21) Appl. No.: 13/624,640

(22) Filed: Sep. 21, 2012

(65) Prior Publication Data

US 2014/0084012 A1 Mar. 27, 2014

(51) Int. Cl.
*E04H 15/32* (2006.01)
*B65D 25/22* (2006.01)

(52) U.S. Cl.
USPC ..... 135/120.1; 220/475

(58) Field of Classification Search
USPC ..... 135/114, 116, 118, 120.1; 108/50.12; 220/475, 592.01, 592.02, 592.2; 248/346.2, 523, 529; 62/457.1, 457.5; 11/114, 116, 118, 120.1
See application file for complete search history.

(56) References Cited

U.S. PATENT DOCUMENTS 3,626,871 A * 12/1971 McClendon ..... 108/151
4,779,635 A 10/1988 Lynch
5,020,764 A * 6/1991 Yamamoto ..... 248/529
5,161,561 A * 11/1992 Jamieson ..... 135/16
5,169,111 A * 12/1992 Dunaj ..... 248/523
5,395,081 A * 3/1995 Vollink ..... 248/218.4
5,493,976 A * 2/1996 Hammond ..... 108/50.12
5,562,288 A 10/1996 Erkebaev
5,737,883 A 4/1998 Rose
5,803,265 A * 9/1998 Bergerman ..... 206/557
6,536,733 B1 * 3/2003 Sharp ..... 248/519
6,554,012 B2 * 4/2003 Patarra ..... 135/16
6,981,680 B1 1/2006 Gordon
7,160,214 B1 1/2007 Rome
7,503,265 B1 * 3/2009 Hammond ..... 108/50.12
7,946,305 B1 5/2011 Mailman
8,181,811 B1 * 5/2012 Blake ..... 220/475
8,424,549 B1 * 4/2013 Goldsmith et al. ..... 135/120.4
2007/0012223 A1 * 1/2007 Flusche ..... 108/26
2011/0000132 A1 * 1/2011 Kamau ..... 47/66.6
2011/0056233 A1 * 3/2011 Flaker et al. ..... 62/457.7

FOREIGN PATENT DOCUMENTS

EP 0514574 B1 5/1991
GB 2185273 A 7/1987

* cited by examiner

*Primary Examiner* — Noah Chandler Hawk
(74) *Attorney, Agent, or Firm* — Miller & Martin PLLC

(57) ABSTRACT

A portable cooler is provided with a sidewall having a channel to facilitate mounting about a vertical pole and thereby weighting a portable canopy structure supported on the pole.

14 Claims, 4 Drawing Sheets

POLE MOUNTED COOLER

FIELD OF THE INVENTION

The present invention is related to beverage coolers. More specifically, the invention is related to coolers adapted to be mounted on or about a pole and their use.

BACKGROUND OF THE INVENTION

A common fixture at outdoor gatherings is a shade providing device such as an umbrella or a canopy tent. These portable shelter devices are most commonly used to provide shade and therefore, protection from the sun. Some structures may even be suitable to provide protection from precipitation. The portable shelters generally consist of one or more poles upon which a framework is supported to hold a protective canopy. Several exemplary designs of these canopy-type shelters can be seen in U.S. Pat. No. 4,779,635, to Lynch, EP 0514574 to Stöockler, and GB 2185273 to Rochelle-Towle. Obviously, many variations of canopy structures are possible, but the most popular tend to be easily collapsed to a portable and transportable configuration and are relatively light weight. Lightweight and inexpensive designs are made using tubular frames. The most common configuration will support a canopy approximately 10 feet square and has a canopy supporting framework that is supported above the ground by four circular or rectangular tubular leg members, typically made from lightweight and relatively light gauge metal.

Because one desirable feature of the portable canopy structures is relatively lightweight construction, in order both to minimize the expense of materials and to maximize the portability of the assembly, the canopy structures are highly susceptible to being knocked about in windy conditions or even when subjected to a moderate breeze. As a result, a number of anchoring systems have been devised. The most lightweight and portable anchoring system in common use is a set of anchoring stakes. One or more stakes may be associated with each pole of the canopy structure. Some stakes are adapted to be driven into the ground immediately adjacent to a canopy pole and attached with a simple attachment and quick-release mechanism. Other stakes are adapted to be positioned away from the canopy poles and fastened with rope or other fastening lines to points near the top of the canopy pole. Both types of stakes suffer from a serious shortcoming in that they are effective only when used in ground that is moderately firm. The stakes cannot be used if the tents are mounted on an asphalt or concrete surface. Similarly, the stakes are ineffective if the surface is too soft, such as when the canopy is mounted on a loose sand surface at a beach. In addition, the stakes that utilize fastening lines create a hazard that can entangle or trip passers-by who are not watchful of the lines.

A second mechanism that is employed to anchor portable canopy structures are leg weights. One example of such a leg weight system is disclosed in U.S. Pat. No. 6,981,680 to Gordon et al. The other variations of such pole or leg weights have been devised, typically with the individual elements having a weight of between 5 and 20 pounds. In use, it is generally recommended that 30 or 40 pounds of weights be deployed in connection with each of the typically four canopy support poles. While weights provide a method of overcoming the shortcoming of the stakes on extremely hard or soft surfaces, the weights detract from the portability of the portable canopy structure. This is because a 10-foot square portable canopy structure might weigh only about 20 pounds and could be carried with relative ease by a single adult. On the other hand, 120 to 160 pounds of weights could require five or six trips by an individual, or the assistance of a group of people, to carry the weights and canopy to a desired location.

The third type of anchoring system that has been devised is comprised of a bag structure that can be filled with relatively heavy materials such as sand, rock, or in some cases, water, to provide an approximately 30 or 40 pound weight. When the bag structure is empty, it can be easily carried. Accordingly, this system of weights is particularly adapted to locations where water or sand is readily available so that the bags can be transported empty, easily filled at the site where the portable canopy will be erected, and then emptied when the portable canopy is ready to be removed. In this fashion, the bag structure can be transported without carrying excess weight.

These weighted bag structures typically either strap about the canopy legs at their base or alternatively may be attached by hanging straps to a point near the top of the canopy poles. The bags utilizing the strap system present some concern due to the possibility of passers-by becoming entangled in the straps. In addition, these systems require additional effort to fill and empty the bags or containers when the canopy is set up and again when collapsed. When filled with sand, it may be difficult to completely empty the bags, with the result that sand and sand fleas or midges may be transported home with their attendant burdens.

Accordingly, despite the several alternatives for anchoring the legs or support poles of portable canopy systems, there remain drawbacks to each of the enumerated systems. Furthermore, because portable canopy assemblies are most commonly utilized at social gatherings such as beach outings, picnics, and sports events, including tailgate activities associated with sports events, coolers of beverages are commonly present during the same activities when the portable canopy structures are being used. By adapting beverage coolers to be utilized for canopy support pole anchor weights, it is possible to maximize the utility of beverage coolers and also avoid unnecessary difficulties with the heretofore inefficient anchoring systems.

SUMMARY OF THE INVENTION

It is an object of the present invention to provide a new and useful beverage cooler configuration to provide stabilizing or anchoring weight for canopy or umbrella support poles.

Another object of the present invention is to provide a mounting system for beverage coolers about a support pole that can adjust the height of the beverage cooler from the ground.

Yet another object of the invention is to provide a technique for anchoring portable canopy structures that overcomes shortcomings of the prior art. Some or all of these objects can be accomplished by various embodiments of the invention.

A preferred beverage cooler according to the present invention is configured so that it can be strapped about a support pole and thereby weight the pole, while still serving the function of a beverage cooler in holding readily dispensed beverages. In order to provide a mechanism for holding the beverage cooler at a desired elevation above the ground, a cantilevered gravity locking arm, a friction locking mount or ratchet locking arm can be provided that is adapted to hold a position on a support pole. In the case of canopies that utilize heavy gauge support poles, such as is more common with very large canopy structures that might accommodate a large gathering of people under several hundred square feet of canopy space, openings can even be drilled through the support poles to receive cross members that the beverage coolers positioned about the poles can rest upon.

A beverage cooler can be mounted around each of four support poles on a 10×10 portable canopy structure and thereby provide about 20 to 40 pounds of weight on each pole.

DETAILED DESCRIPTION OF A PREFERRED EMBODIMENT

Figure 4:
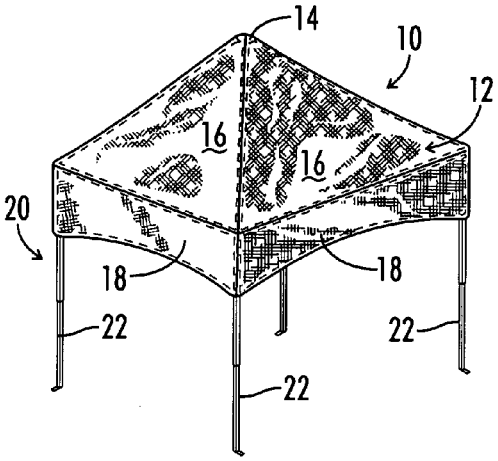
FIG. 4 (PRIOR ART)
FIG. 4 shows a typical prior art portable canopy structure in its erected state with no weighting or anchors on the support poles.

The present invention is directed toward a novel beverage cooler design adapted for use as an anchor weight on the support poles of a canopy structures and umbrellas. FIG. 4 shows a representative portable canopy structure 10 having a plastic or fabric cover 12 including a central peak 14, top cover panel 16, side cover panels 18, a rectangular tubular metal frame 20 including four corner support members, such as legs 22. It will be understood that portable canopy structures come in a wide variety of designs, and the metal frame 20 could be plastic in some cases, or made of various thicknesses and alloys of metal. The frame structure itself may take varying shapes to provide for different sizes and shapes of canopies, and to provide for various methods of folding or disassembling the frame when the canopy is not in use.

Figure 1:
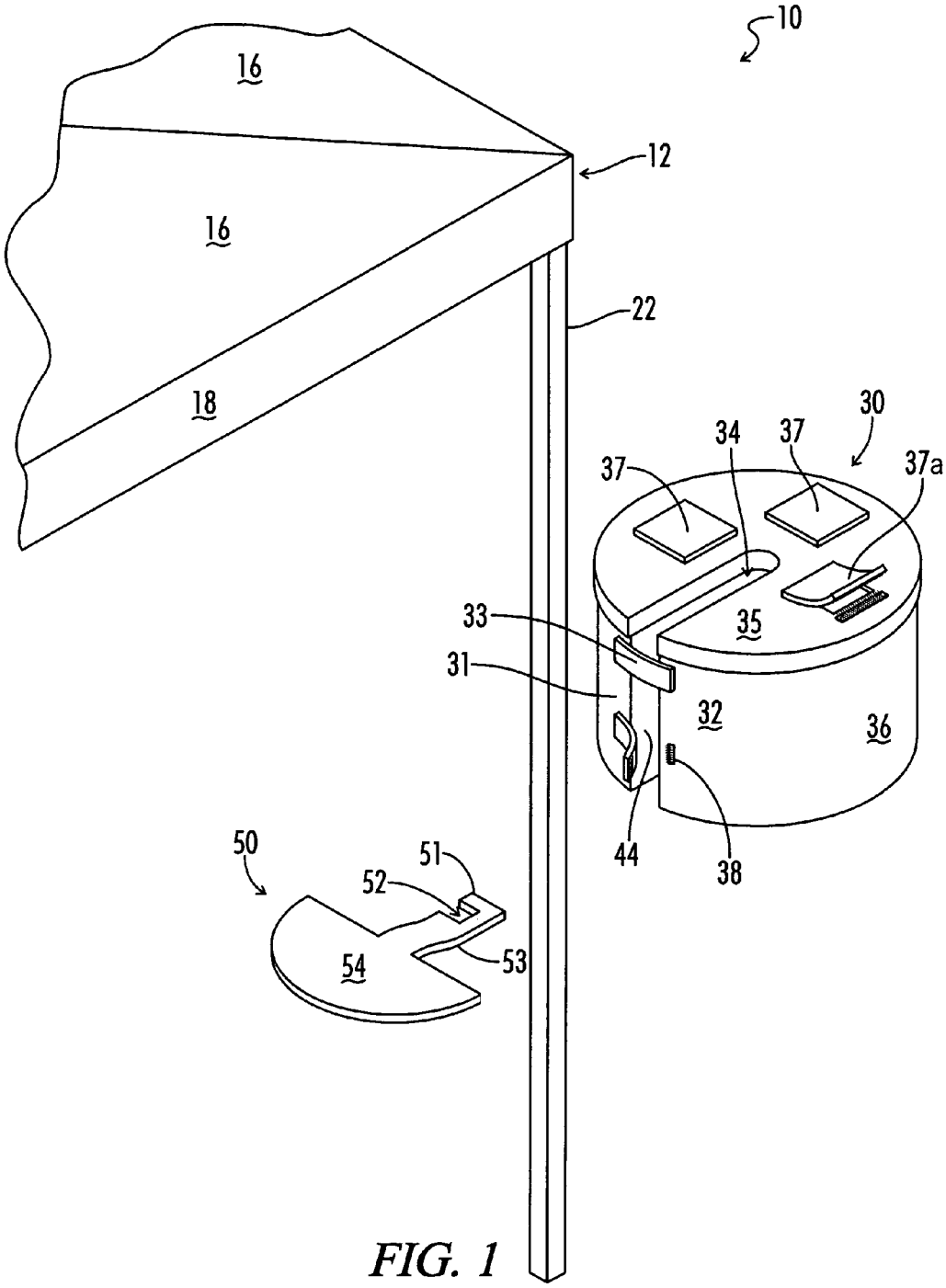
FIG. 1 is a perspective view of an exemplary beverage cooler according to the invention together with a cantilevered gravity locking arm and a pole extending downward from a canopy corner toward the ground or support surface.
Figure 2:
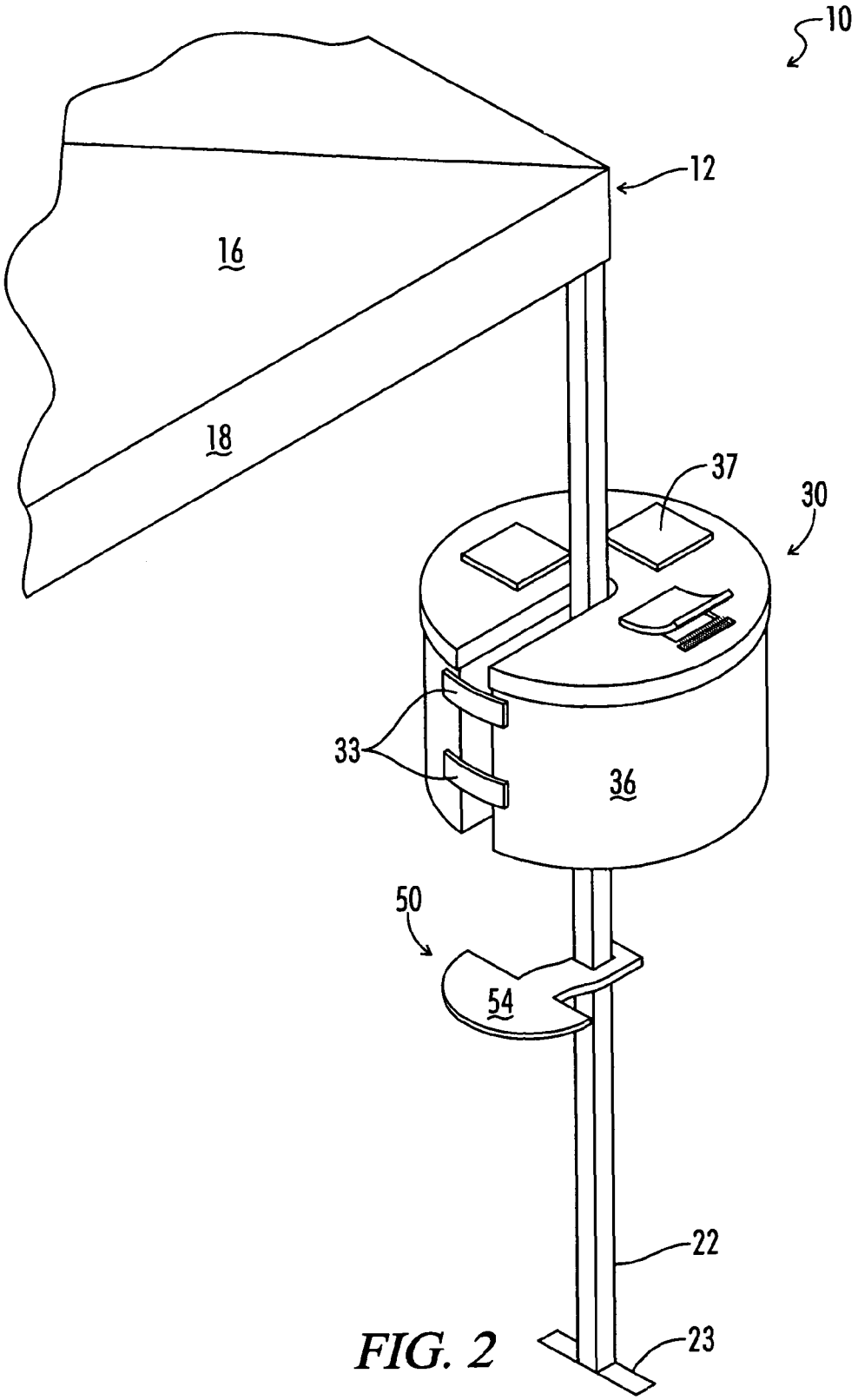
FIG. 2 shows the beverage cooler positioned about the support pole with the cantilevered arm positioned on the pole.
Figure 3:
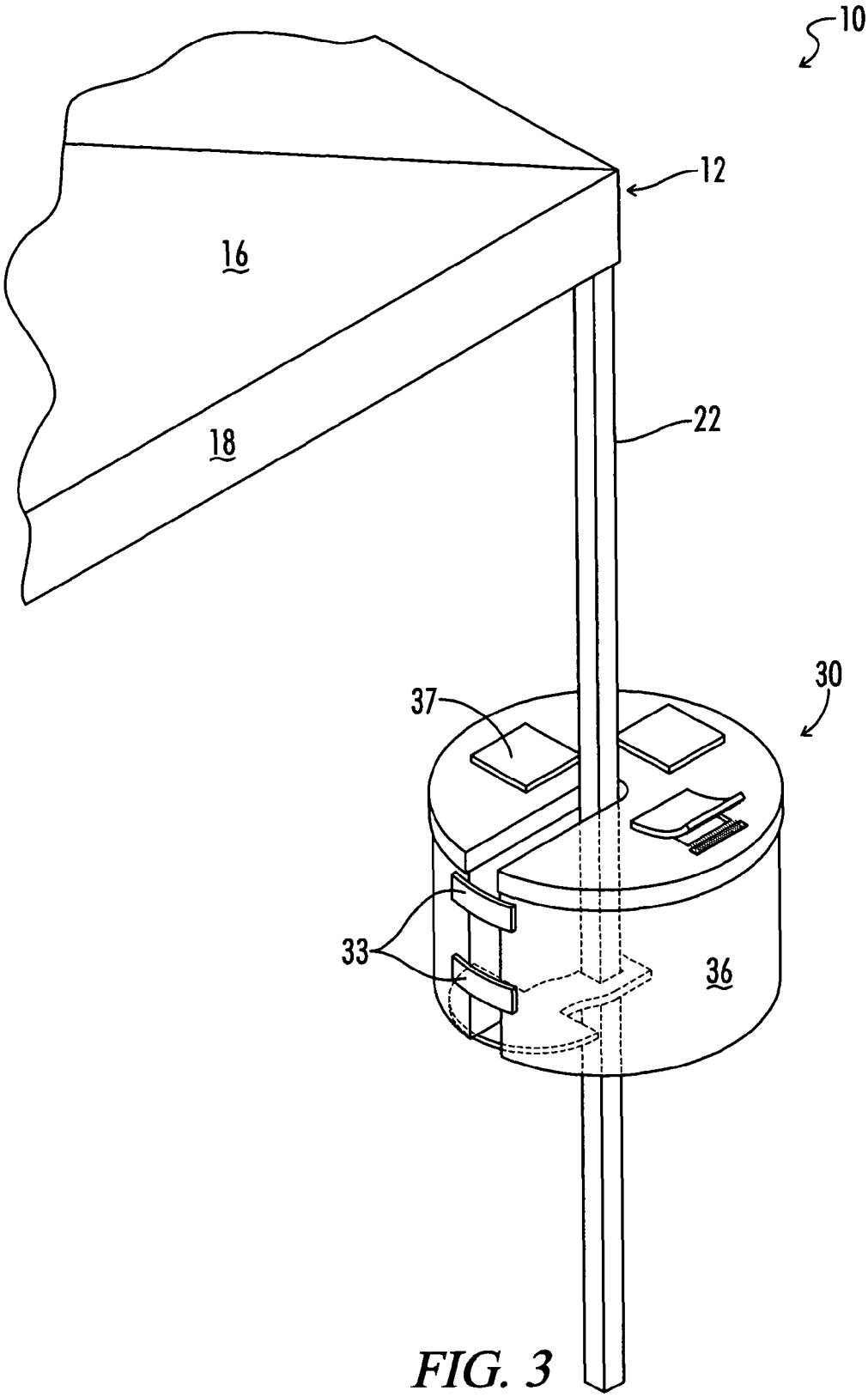
FIG. 3 shows the beverage cooler being supported above the ground on the cantilever arm.

A corner of the portable canopy 10 is shown in isolation in FIGS. 1-3 with two top cover panels 16 and one side cover panel 18 visible, together with a corner support pole, or leg 22. Also shown in FIG. 1 is a cooler 30 according to the present invention with a top 35, an exterior side wall 36 and a bottom 41 (shown in FIG. 5). Between the top, bottom and side wall, an insulated cavity is defined having width and depth, and being adapted for holding ice, food, and beverages. It can be seen that a channel 34 or groove divides the exterior wall 36 into a left side portion 31 and a right side portion 32. The channel 34 extends inward from the sidewall to about the mid-point of the width of the insulated cavity, or slightly beyond. The channel can be U-shaped as shown, or more angular in construction. Connecting straps 33 join the left side 31 to the right side 32 about the channel and might advantageously utilize a hook and loop fastener material, as with the hook fastener portion 38 shown attached on the right side 32. In the illustrated embodiment, the top 35 has three flaps 37 to facilitate access to the interior of the cooler and flap 37*a* is shown in a partially open position.

The cooler 30 may rest on the ground or be supported above the ground either by straps hanging from the top of leg 22 or adjacent frame members at the corner of the canopy structure 10, or by a support device that lockingly engages the leg 22. The support device can be a friction locking device or, as illustrated, a cantilevered gravity locking arm 50, or any other support that can be securely positioned on the leg 22. The cantilevered gravity locking arm 50 has a channel 52 which fits about the exterior of leg 22 with finger 51 on one side and the arm 53 on the opposite side and the support plate 54 at the end of arm 53. The arm 53 extends slightly upward from the channel 52 to the support plate to provide an offset. When the leg 22 is received in groove 52 and weight is applied to plate 54, the leg 22 is clamped between the finger 51 and arm 53 so that the cooler applying weight to plate 54 is supported above the ground.

FIG. 2 shows the cooler positioned with leg 22 received fully in the channel 34 of the cooler 30 and straps 33 fastening left and right sides 31,32 about the leg. The cantilevered gravity locking arm 50 has been positioned on the leg 22, but because no weight is on the arm, it can be freely moved upward or downward to a desired height. In FIG. 3 the cooler has been placed so that it rests upon the plate 54 of the cantilevered gravity locking arm, causing the sides of the channel 52 to engage with opposed sides of the leg 22 and thereby support the cooler 30 above the ground.

Figure 5:
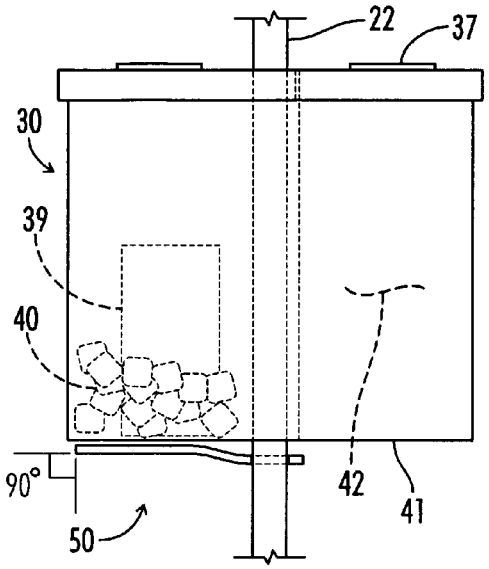
FIG. 5 is a side view of the beverage cooler about the support pole and being lowered into contact with a cantilevered locking arm in a level position, not yet engaged with the sides of the pole.
Figure 6:
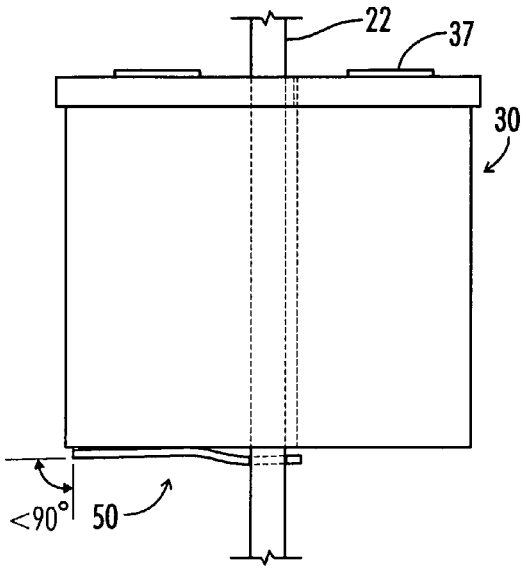
FIG. 6 shows a beverage cooler disposed about the support pole and resting upon a cantilever locking arm thereby depressing the arm at a slight angle so that it has engaged with the sides of the pole to lock into position.
Figure 7:
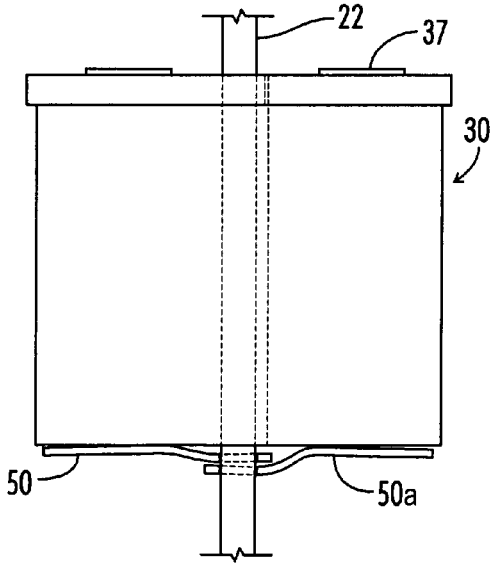
FIG. 7 shows a beverage cooler disposed about a support pole with a double cantilevered locking arm support.

FIG. 5 illustrates a side view of a cooler 30 according to the invention with the interior of the cooler 42 shown in phantom with beverage container such as can 39 and cooling ice 40. In use, the interior height or depth of the cooler will preferably hold two beverage containers stacked upon one another, and a total of approximately twenty-four 12 ounce beverages, or the equivalent. This results in a cooler cavity having an interior width of 16 or more inches and an interior height of at least about 10 inches. In FIG. 5, the cantilevered gravity locking arm 50 is depicted with plate 54 in a perfectly horizontal position, so that no weight has been placed on the arm. In FIG. 6, weight has been applied to the plate 54 and the arm 50 is now slightly misaligned from the horizontal resulting in the clamping of finger 51 and arm 53 to the leg 22. As shown in FIG. 7, in order to provide even greater security for the support of cooler 30, a double set of cantilevered gravity locking arms may be utilized with the second arm 50*a* and having a slightly greater offset between the finger 51 and groove 52 and the plate 54 in comparison with the first arm 50.

Accordingly, in use it is contemplated that the portable canopy structure 10 will be erected and that a cooler 30 according to the invention will be mounted about each of the four legs of the canopy structure. The coolers 30, prior to mounting, will be filled with some ice and/or beverages to provide weight to the cooler 30. Coolers may then be placed on the ground if the feet or legs 22 have a base cross-member, such as foot 23 (shown in FIG. 2) for the cooler to rest upon. However, in the preferred embodiments, the legs 22 will have a friction lock or cantilevered gravity lock type device so that the coolers 30 may be supported above the ground for easy access to beverages within. Alternatively, the coolers 30 may be provided with straps to hang from the upper portion of legs 22 or from the frame 20 adjacent to the upper portion of legs 22. When four full coolers are in place on the legs of a portable canopy 10, the canopy is substantially anchored by their weight against breezes and light winds that might otherwise move or tumble the canopy from its erect and desired position.

It is preferred for manufacturing costs and ease of storage that the coolers 30 be made collapsible, with soft sides, however, it will be understood that suitable coolers could also be manufactured of rigid plastics or other materials commonly used in beverage cooler design. Also, while the illustrated coolers are generally circular in appearance and have a relatively narrow channel 34 to receive the legs 22, suitable cooler designs could be ovular, or more rectangular in shape and a larger opening to receive the legs 22 could be provided. It is generally only required that the left side and right side 31,32 be capable of being joined about the leg and that the interior wall 44 of the channel 34 form a substantially acute angle. The top of the cooler 30 can be hinged, zippered, or designed in many alternative fashions known in the beverage cooler field.

Numerous alterations of the structure herein disclosed will suggest themselves to those skilled in the art. However, it is to be understood that the present disclosure relates to a presently preferred embodiment of the invention which is for purposes of illustration only and not to be construed as a limitation of the invention. All such modifications which do not depart from the spirit of the invention are intended to be included within the scope of the appended claims.

I claim:

1. A portable beverage cooler having a top, a bottom, and a side wall therebetween defining an insulated cavity having width and height, in combination with a canopy structure having a plurality of vertical poles, so that a vertical pole of the canopy structure passes from the bottom upward through the top external of the insulated cavity, but proximate thereto, so that first and second insulated cavity portions are disposed on opposite first and second sides of the vertical pole and the bottom rests upon a first cantilevered gravity arm mounted on the vertical pole to extend a support plate to the first side and a second cantilevered gravity arm mounted on the vertical pole to extend a support plate to the opposite second side wherein the side wall is flexible so that when the insulated cavity is empty, the portable beverage cooler can be collapsed.

2. The portable beverage cooler of claim 1 further comprising a fastener connecting the insulating cavity portions about the vertical pole.

3. The portable beverage cooler of claim 1 wherein the insulated cavity is at least partially filled with at least one of the group of ice and beverages.

4. The portable beverage cooler of claim 1 wherein the width of the insulated cavity is at least sixteen inches.

5. The portable beverage cooler of claim 1 wherein the height of the insulated cavity is at least ten inches.

6. The portable beverage cooler of claim 1 wherein the insulated cavity has a size adequate to hold 24 twelve ounce beverage containers.

7. A portable beverage cooler having a top, a bottom, and a side wall therebetween defining an insulated cavity having width and height, in combination with a canopy structure having a plurality of vertical poles, so that a vertical pole of the canopy structure passes from the bottom upward through the top external of the insulated cavity, but proximate thereto, so that first and second insulated cavity portions are disposed on opposite first and second sides of the vertical pole and the bottom rests upon a first cantilevered gravity arm mounted on the vertical pole to extend a support plate to the first side and a second cantilevered gravity arm mounted on the vertical pole to extend a support plate to the opposite second side wherein the insulated cavity is at least partially filled with beverage containers.

8. The portable beverage cooler of claim 7 wherein the insulated cavity is partially filled with ice.

9. A portable beverage cooler having a top, a bottom, and a side wall therebetween defining an insulated cavity having width and height, in combination with a canopy structure having a plurality of vertical poles, so that a vertical pole of the canopy structure passes from the bottom upward through the top external of the insulated cavity, but proximate thereto, so that first and second insulated cavity portions are disposed on opposite first and second sides of the vertical pole and the bottom rests upon a first cantilevered gravity arm mounted on the vertical pole to extend a support plate to the first side and a second cantilevered gravity arm mounted on the vertical pole to extend a support plate to the opposite second side wherein the first and second cantilevered gravity arms have a channel that fits about the vertical pole with a finger to one side of the channel and an arm extending to the support plate on the opposite side of the channel such that the arm extends upward from the channel to the support plate in a manner to offset the support plate from the channel.

10. The portable beverage cooler of claim 9 wherein the support plate of the second cantilevered gravity arm is offset from the channel by a greater amount than the support plate of the first cantilevered gravity arm.

11. A method of securing a portable canopy structure using a portable beverage cooler having a top, a bottom, and a side wall therebetween defining an insulated cavity, the side wall having a fastener thereon, and the portable canopy structure having a plurality of vertical poles comprising the steps of:

(a) at least partially filling the portable beverage cooler with one or more of the group of ice and beverages;

(b) positioning first and second insulated cavity portions about opposite first and second sides of a vertical pole and fastening the portable beverage cooler about the vertical pole;

(c) supporting the bottom of the portable beverage cooler above the ground upon first and second cantilevered gravity arms;

wherein the first and second cantilevered gravity arms have a channel that fits about the vertical pole with a finger on one side and an arm extending to the support plate on the opposite side and the arm extends upward from the channel to the support plate such that the support plate is offset from the channel.

12. The method of claim 11 wherein the offset of the second cantilevered gravity arm is greater than the offset of the first cantilevered gravity arm.

13. A method of securing a portable canopy structure using a portable beverage cooler having a top, a bottom, and a side wall therebetween defining an insulated cavity, the side wall having a fastener thereon, and the portable canopy structure having a plurality of vertical poles comprising the steps of:

(a) at least partially filling the portable beverage cooler with one or more of the group of ice and beverages;

(b) positioning first and second insulated cavity portions about opposite first and second sides of a vertical pole and fastening the portable beverage cooler about the vertical pole;

(c) supporting the bottom of the portable beverage cooler above the ground upon first and second cantilevered gravity arms;

wherein the insulated cavity is at least partially filled with beverage containers.

14. The method of claim 13 wherein the portable canopy structure is a canopy supported with at least four vertical pole legs and a portable beverage cooler is secured about each of four vertical pole legs.

* * * * *